US009930966B2

(12) United States Patent
Yang

(10) Patent No.: US 9,930,966 B2
(45) Date of Patent: Apr. 3, 2018

(54) COMPACT COLLAPSIBLE CHAIR

(71) Applicant: Zhejiang Hengfeng Top Leisure Co., Ltd., Hangzhou, Zhejiang (CN)

(72) Inventor: Baoqing Yang, HangZhou (CN)

(73) Assignee: ZHEJIANG HENGFENG TOP LEISURE CO., LTD., Hangzhou (CN)

( * ) Notice: Subject to any disclaimer, the term of this patent is extended or adjusted under 35 U.S.C. 154(b) by 107 days.

(21) Appl. No.: 15/227,110

(22) Filed: Aug. 3, 2016

(65) Prior Publication Data

US 2018/0035806 A1 Feb. 8, 2018

(51) Int. Cl.

| | |
|---|---|
| ***A47C 4/00*** | (2006.01) |
| ***A47C 4/42*** | (2006.01) |
| ***A47C 4/28*** | (2006.01) |
| ***A47C 5/10*** | (2006.01) |

(52) U.S. Cl.

CPC ..... *A47C 4/42* (2013.01); *A47C 4/28* (2013.01); *A47C 5/10* (2013.01)

(58) Field of Classification Search

CPC ..... A47C 9/105; A47C 4/286; A47C 4/28; A47C 4/02; A47C 4/03; A47C 4/00

USPC ..... 297/16.1, 16.2, 440.11, 45, 440.24, 297/452.13

See application file for complete search history.

(56) References Cited

U.S. PATENT DOCUMENTS

| | | | | |
|---|---|---|---|---|
| 6,770,156 | B2 * | 8/2004 | Allen | B32B 5/26 156/62.4 |
| 7,229,128 | B2 * | 6/2007 | Lee | A47C 4/286 248/188.6 |
| 8,454,084 | B2 | 6/2013 | Lah | |
| 2010/0283295 | A1 * | 11/2010 | Smith | A47C 4/286 297/16.2 |
| 2011/0169305 | A1 * | 7/2011 | Ayre | A47C 4/283 297/45 |
| 2014/0265459 | A1 * | 9/2014 | Gambino | A47C 3/18 297/35 |

* cited by examiner

*Primary Examiner* — Chi Q Nguyen
(74) *Attorney, Agent, or Firm* — Thompson Coburn LLP

(57) ABSTRACT

A collapsible chair comprises a pair of intermediate frame members, seat support poles, leg poles, and a pliable seat. The intermediate frame members can be oriented in a crossed manner or can be oriented, via a pivot connection between the two, such that they are parallel. Each intermediate frame member comprises pole sockets. The seat support poles are removably securable to the intermediate frame members via the pole sockets. The leg poles are also removably securable to the intermediate frame members via the pole sockets. The pliable seat is removably attachable to all four of the seat support poles in a manner such that the seat support poles can support the seat, with the leg poles supporting the intermediate frame members, and the intermediate frame members supporting the seat support poles.

11 Claims, 6 Drawing Sheets

COMPACT COLLAPSIBLE CHAIR

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention relates generally to collapsible furniture. More particularly, the present invention pertains to lightweight collapsible chairs that can be compactly stored.

General Background

Ultra-compact collapsible chairs are known. For example, U.S. Pat. No. 8,454,084, issued Jun. 4, 2013, discloses a collapsible chair in which the various structural poles that make up the frame of the chair can be disassembled from each other and yet, via shock cord, remain connected. Such structural poles can then be compactly stored together and placed in a bag.

In general, there remains a market for ultra-compact collapsible chairs. The chair of the present invention is lightweight and is ultra-compact when collapsed for storage of travel.

SUMMARY OF THE INVENTION

The chair of the present invention utilizes a novel collapsible frame configuration that is both strong and able to be compactly collapsed.

In one aspect of the invention, collapsible chair is adjustable between a useable configuration and a collapsed configuration. The collapsible chair comprises a pair of intermediate frame members, a pair of front and rear seat support poles, a pair of front and rear leg poles, and a pliable seat. The intermediate frame members are pivotally connected to each other in a manner such that the intermediate frame members can be oriented in a crossed manner when the chair is in the usable configuration and, alternatively, parallel to each other when the chair is in the collapsed configuration. Each of the intermediate frame members comprises opposite front and rear longitudinal end portions and each of the end portions comprises upwardly and downwardly facing pole sockets. Each of the front seat support poles is removably securable to the upwardly facing pole socket of the front end portion of a respective one of the intermediate frame members. Each of the rear seat support poles is removably securable to the upwardly facing pole socket of the rear end portion of a respective one of the intermediate frame members. The seat support poles are secured to the intermediate frame members when the chair is in the usable configuration and are detached from the intermediate frame members when the chair is in the collapsed configuration. Each of the front leg poles is removably securable to the downwardly facing pole socket of the front end portion of a respective one of the intermediate frame members. Each of the rear leg poles is removably securable to the downwardly facing pole socket of the rear end portion of a respective one of the intermediate frame members. The leg poles are secured to the intermediate members when the chair is in the usable configuration and are detached from the intermediate members when the chair is in the collapsed configuration. The pliable seat is removably attachable to all four of the seat support poles in a manner such that the seat support poles can support the seat, with the leg poles supporting the intermediate frame members, and the intermediate frame members supporting the seat support poles.

Further features and advantages of the present invention, as well as the operation of the invention, are described in detail below with reference to the accompanying drawings.

Figure 1:
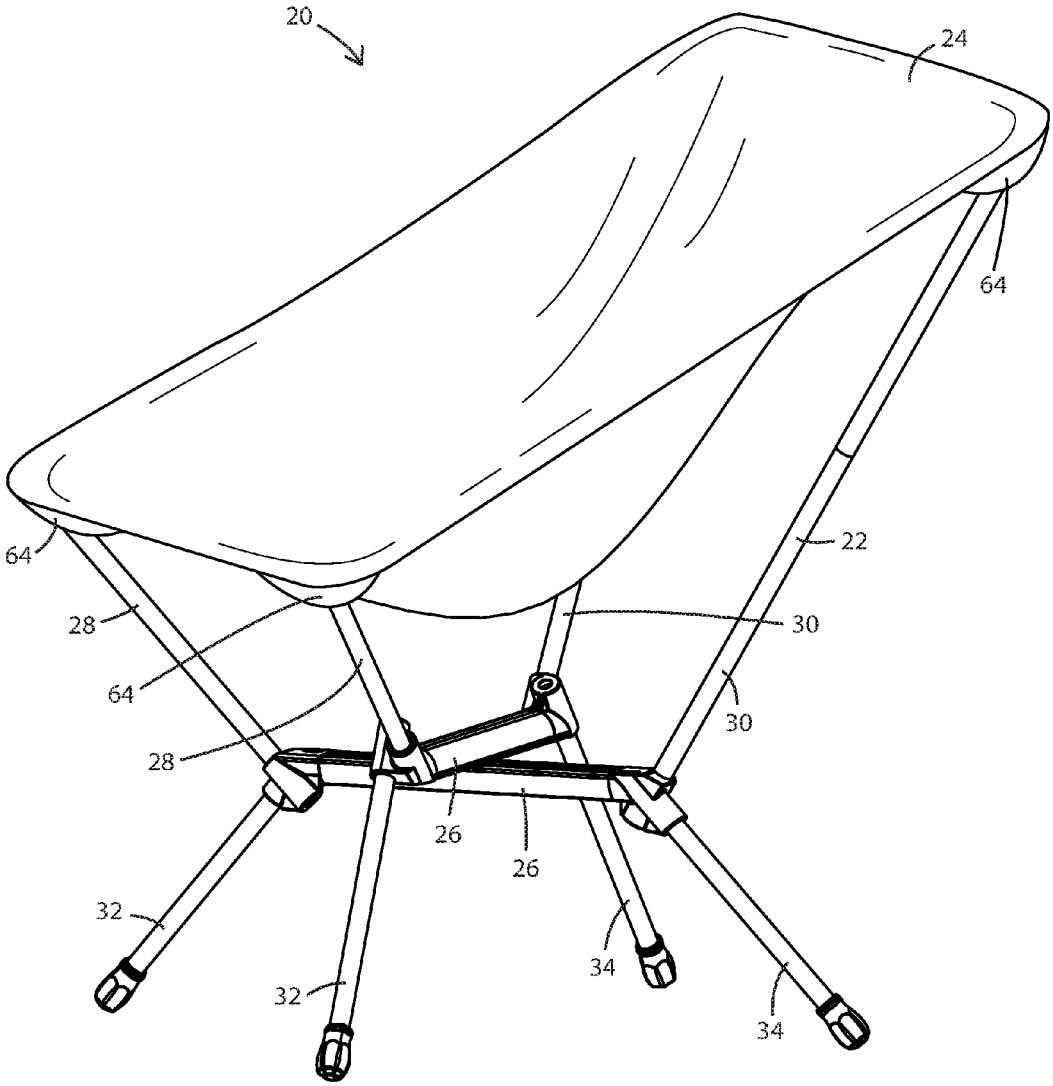
FIG. 1 depicts an embodiment of a chair in accordance with the invention and shows the chair in its usable configuration.
Figure 2:
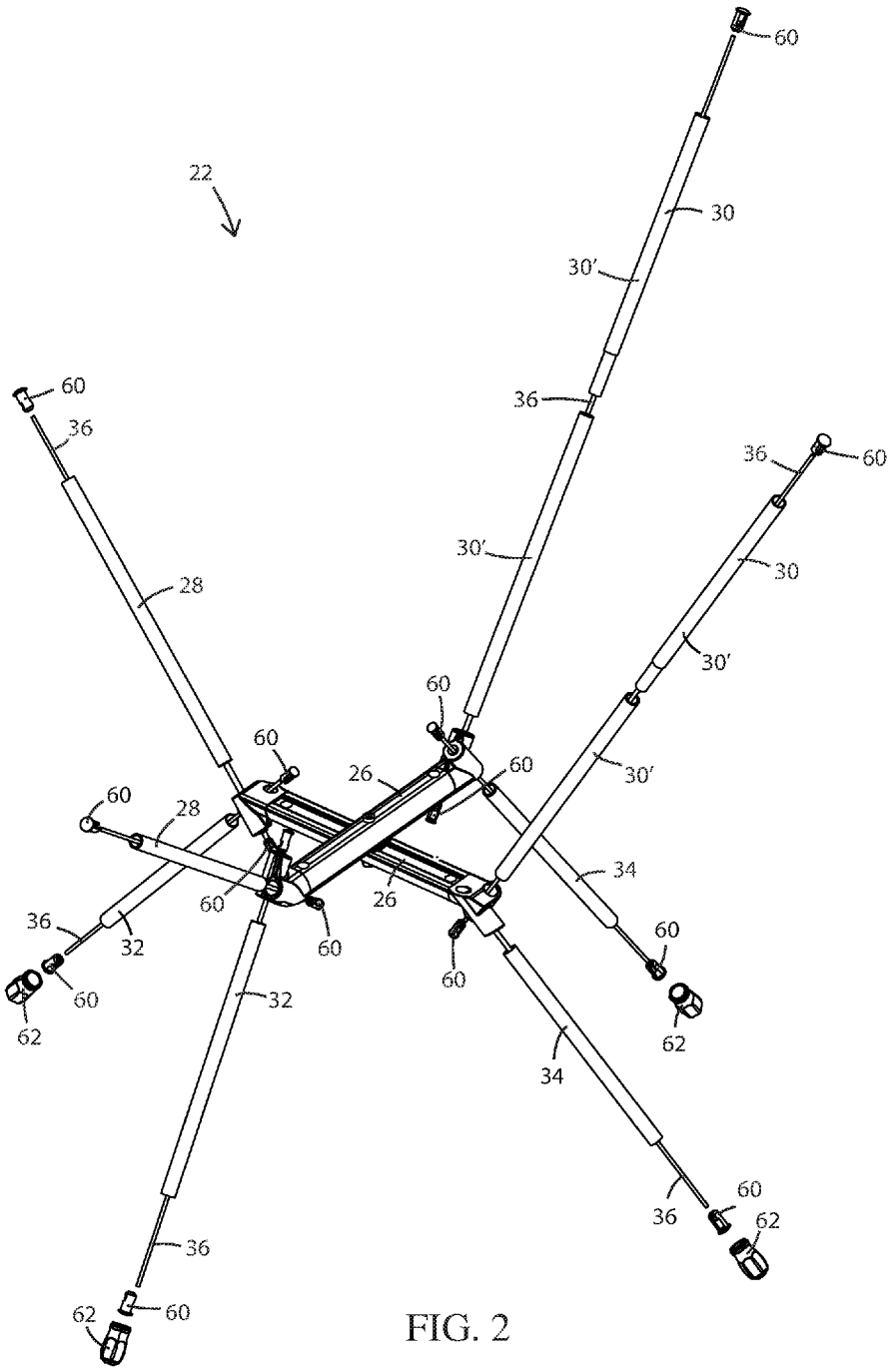
FIG. 2 depicts an exploded view of the frame of the chair shown in FIG. 1.
Figure 3:
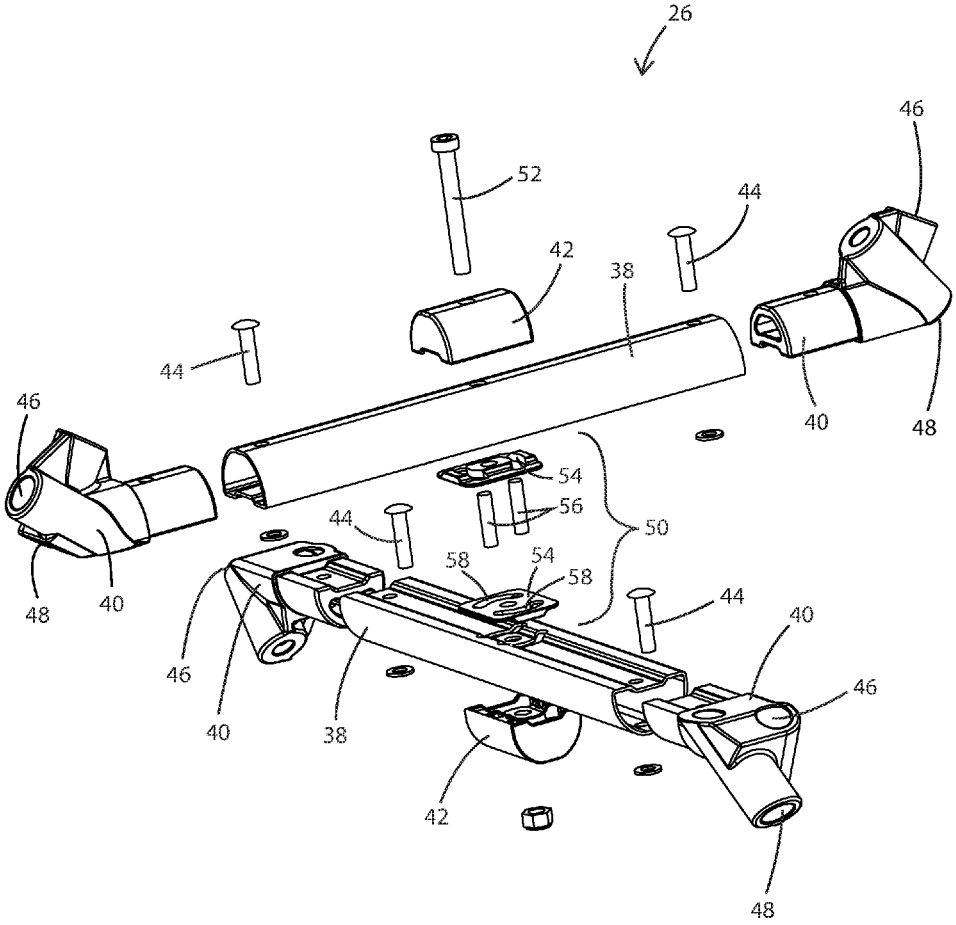
FIG. 3 depicts an assembly view of the intermediate frame members of the chair frame.
Figure 4:
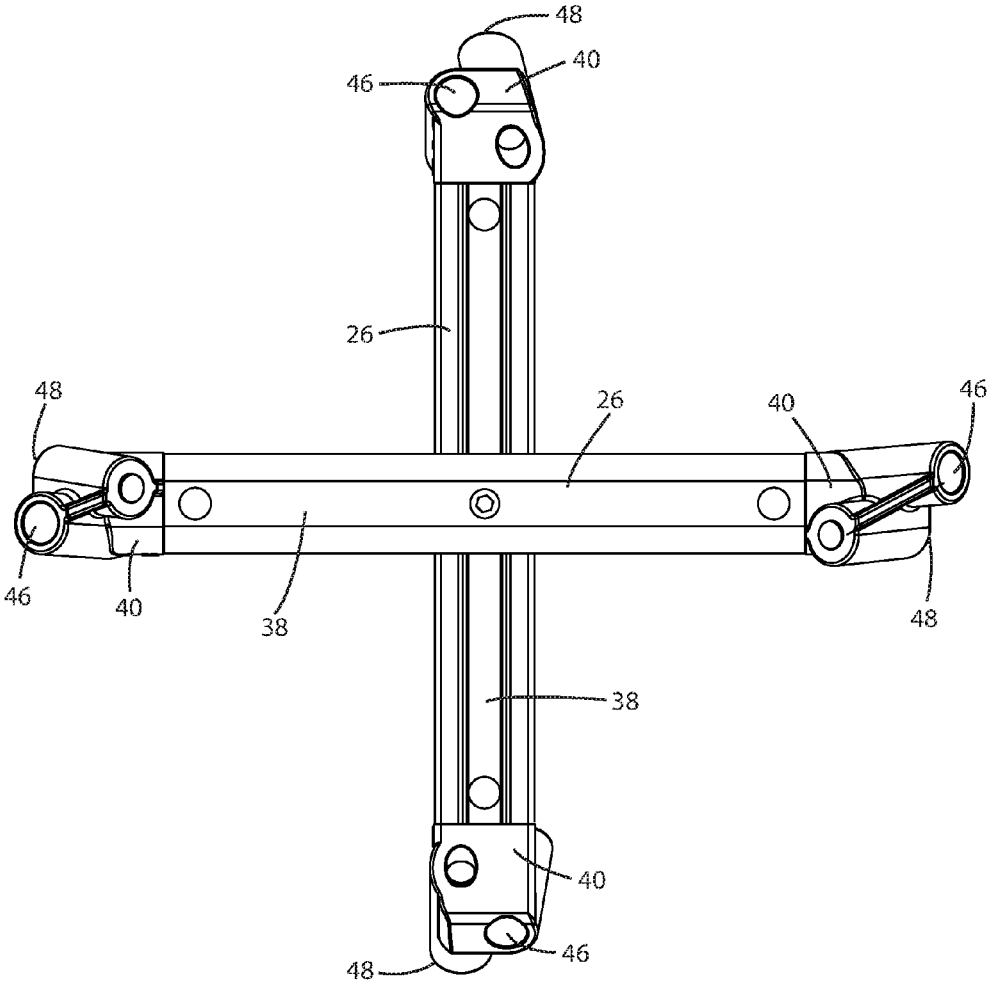
FIG. 4 depicts the intermediate frame members at their maximum angle of pivot.
Figure 5:
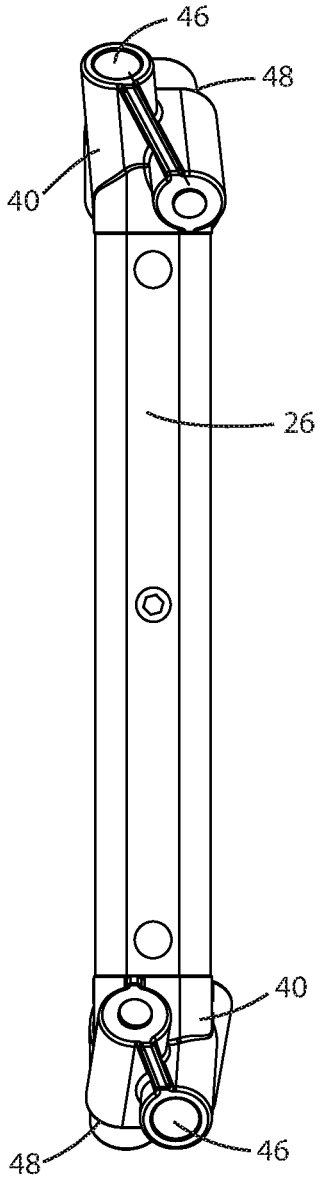
FIG. 5 depicts the intermediate frame members in their collapsed orientation, at which they are parallel.

Reference numerals in the written specification and in the drawing figures indicate corresponding items.

DETAILED DESCRIPTION

An embodiment of a collapsible chair (20) in accordance with the invention is shown in FIG. 1 and comprises a frame (22) and a pliable seat (24). The chair (20) is collapsible from its usable configuration (shown in FIG. 1) and is configured to be very compact when in its collapsed configuration (shown in FIG. 6).

The frame (22) of the chair (20) comprises a pair of intermediate frame members (26), a pair of front seat support poles (28), a pair of rear seat support poles (30), a pair of front leg poles (32), a pair of rear leg poles (34), and shock cords (36). Each intermediate frame member (26) comprises a main tube (38), which is preferably metal, a pair of end fittings (40), and a stiffener (42). The end fittings (40) are attached to the ends of the main tubes (38) via rivets (44). Each end fitting (40) comprises an upwardly facing pole socket (46) and a downwardly facing pole socket (48). The upwardly facing pole socket (46) and a downwardly facing pole socket (48) are skewed at an angle from being vertical. A pivot limiter (50) is sandwiched between the intermediate frame members (26), preferably at the longitudinal center of the main tubes (38). A bolt (52) is preferably used to pivotally attach the intermediate frame members (26) to each other. Prior to doing that, the stiffeners (42) are inserted into their respective main tubes (38) and positioned at the longitudinal centers of the main tubes. Thus, the bolt (52) passes through the main tubes (38), through the stiffeners (42), and through the pivot limiter (50). The pivot limiter (50) is preferably a dual-plate (54), dual-pin (56) pivot limiter, with each plate comprising a pair of crescent slots (58) through which the pins pass to thereby limit the degree to which the plates can pivot relative to each other. The slots (58) are preferably configured to limit the range of pivotal motion to ninety degrees.

The front seat support poles (28), front leg poles (32), and rear leg poles (34) each comprise only a single pole section, whereas the rear set support poles (30) each comprise two pole sections (30') that can be detached from each other. The rear seat support poles (30) are appreciably longer than the other poles, but all the pole sections are relatively similar in length. The poles (28, 30, 32, 34) are preferably standard hollow aluminum tubes and a shock cord (36) passes through each of the poles and to a respective one of the pole sockets (46, 48) of intermediate frame members (26) to thereby connect the poles to their respective sockets in a standard manner. Preferably each pole has its own shock cord (36). Standard shock cord stoppers (60) are used to maintain the shock cords (36) resiliently stretched. A rubber foot (62) is preferably attached to the bottom end of each of the front leg poles (32) and each of the rear leg poles (34). When the chair (20) is in the usable configuration, the seat support poles (28, 30) diverge away from each other as they extend upward from the intermediate members (26) and the leg poles (32, 34) diverge away from each other as they extend downward from the intermediate frame members.

The pliable seat (24) is preferably made of polymeric materials and may include screen mesh portions to provide for ventilation. The seat (24) is generally rectangular with round edges and bulges out-of-plane as it extends inward from its perimeter, when perimeter is generally planer. Each corner of the seat (24) comprises a pole receiving pocket (64), all of which are on the same side of the seat.

Figure 6:
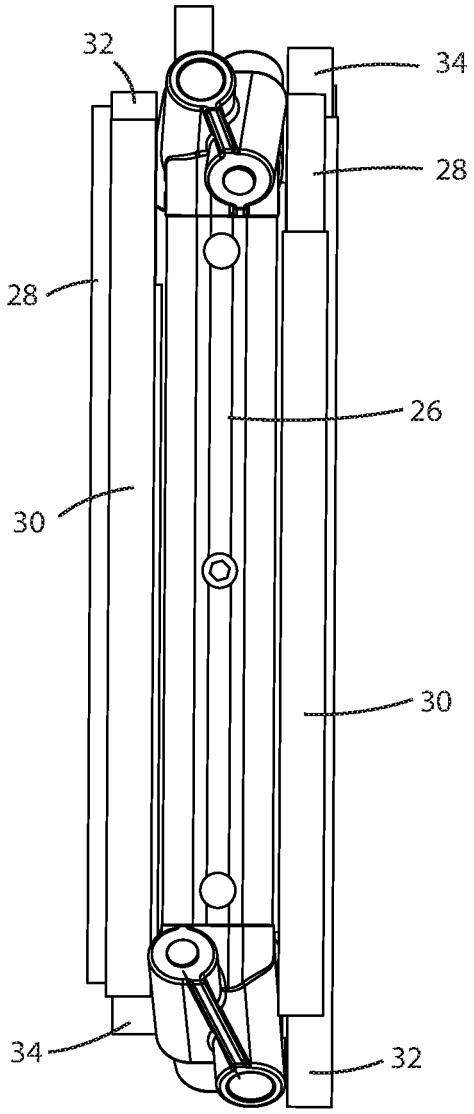
FIG. 6 depicts the entire frame in its collapsed configuration.

In its collapsed configuration, the frame of the chair is compact, as is shown in FIG. 6. In that configuration, all of the poles/pole segments and the intermediate frame members are generally parallel and positioned side-by-side. Although the poles are not secured to the pole sockets of the intermediate frame members in the collapsed configuration, they remain attached to intermediate frame members via the shock cords. The pliable seat can be folded and wrapped around the collapsed frame and the assembly may then be placed in a storage bag (not shown). The collapsed chair is compact enough to be stored within a small backpack or even a purse.

When it is desired to assemble the chair for use, the frame and pliable seat are removed from the bag and the poles are then attached to the pole sockets of the intermediate frame members. The shock cords facilitate this by urging the poles into the sockets and also by preventing any confusion as to which socket each pole should be secured to. Before, during, or after securing the poles to the intermediate frame members, the intermediate frame members are pivoted relative to each other to space out the poles and prepare the seat support poles for receiving the seat. The seat is attached to the ends of the seat support poles by inserting the ends of the seat support poles into the pockets provided at the corners of the seat. Once the foregoing is achieved, the chair is fully assembled and is in its usable configuration (shown in FIG. 1). The out of plane bulge in the seat is configured so that, in use, the seat cradles a person's lower torso, buttocks, and upper thighs. As shown in FIG. 1, the perimeter of the seat is such that the perimeter edges of the seat are taut when attached to the frame. As such, the front and rear edges of the seat hold the intermediate frame members in their maximum crossed state, thereby making the chair very stable without having to include any form of locking mechanism to hold the intermediate frame members in their maximum crossed state. These steps of assembly are simply reversed to collapse the chair for storage or transport.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent.

What is claimed is:

1. A collapsible chair that is adjustable between a useable configuration and a collapsed configuration, the collapsible chair comprising:

a pair of intermediate frame members, the intermediate frame members being pivotally connected to each other about a pivot axis in a manner such that the intermediate frame members can be oriented in a crossed manner when the chair is in the usable configuration and, alternatively, parallel each other when the chair is in the collapsed configuration, each of the intermediate frame members comprising opposite front and rear longitudinal end portions and each of the end portions comprising upwardly and downwardly facing pole sockets;

a pair of front and a pair of rear seat support poles, each of the front seat support poles being removably securable to the upwardly facing pole socket of the front end portion of a respective one of the intermediate frame members, each of the rear seat support poles being removably securable to the upwardly facing pole socket of the rear end portion of a respective one of the intermediate frame members, the seat support poles being secured to the intermediate frame members when the chair is in the usable configuration and being detached from the intermediate frame members when the chair is in the collapsed configuration;

a pair of front and a pair of rear leg poles, each of the front leg poles being removably securable to the downwardly facing pole socket of the front end portion of a respective one of the intermediate frame members, each of the rear leg poles being removably securable to the downwardly facing pole socket of the rear end portion of a respective one of the intermediate frame members, the leg poles being secured to the intermediate members when the chair is in the usable configuration and being detached from the intermediate members when the chair is in the collapsed configuration; and a pliable seat, the seat being removably attachable to all four of the seat support poles in a manner such that the seat support poles can support the seat, with the leg poles supporting the intermediate frame members and the intermediate frame members supporting the seat support poles, when the chair is in the usable configuration and such that the seat can be removed from the seat support poles and folded when the chair is in the collapsed configuration.

2. A collapsible chair in accordance with claim 1 wherein the intermediate frame members are pivotally connected to each in a manner such that the intermediate frame members can pivot about the axis relative to each other only to a maximum angle from being parallel.

3. A collapsible chair in accordance with claim 2 wherein, when the seat is in the usable configuration, the seat is tautly suspended between the rear seat support poles and is tautly suspended between the front seat support poles, and the tautness of the seat acts to maintain the intermediate frame members at the maximum angle from being parallel.

4. A collapsible chair in accordance with claim 3 wherein, when the seat is in the usable configuration, the seat is tautly suspended between each of the front seat poles and a respective one of the rear seat support poles.

5. A collapsible chair in accordance with claim 3 wherein the maximum angle is ninety degrees.

6. A collapsible chair in accordance with claim 1 wherein the pivot axis is centered longitudinally along each of the intermediate frame members.

7. A collapsible chair in accordance with claim 1 wherein the pole sockets are oriented such that the seat support poles diverge from each other as the seat support poles extend upward, and the leg poles diverge from each other as the leg poles extend downward, when the chair is in the usable configuration.

8. A collapsible chair in accordance with claim 1 wherein each of the rear seat support poles comprises two pole segments that are removably securable to each other.

9. A collapsible chair in accordance with claim 8 wherein each of the front seat support poles and each of the leg poles comprise only a single pole segment.

10. A collapsible chair in accordance with claim 1 wherein shock cords connect the seat support poles and leg poles to the pole sockets of the intermediate frame members.

11. A collapsible chair in accordance with claim 10 wherein the chair comprises at least four shock cords and each of the four shock cords attaches just one of the seat supports poles and leg poles to the respective one of the pole sockets.

* * * * *